United States Patent [19]

Ketterer

[11] 4,215,436

[45] Aug. 5, 1980

[54] HEADWEAR MOUNTED TRANSPARENT FILM DISTRIBUTING MEANS

[76] Inventor: Jack L. Ketterer, 525 Oak Ave. East, St. Michael, Minn. 55376

[21] Appl. No.: 48,614

[22] Filed: Jun. 14, 1979

[51] Int. Cl.[2] ..... A42B 1/06

[52] U.S. Cl. ..... 2/422; 2/424; 2/438; 2/205; 242/75.4

[58] Field of Search ..... 2/438, 422, 8, 9, 10, 2/424, 202, 205; 242/75.4, 75.2, 75.45, 129.8, 156

[56] References Cited

U.S. PATENT DOCUMENTS

| | | | |
|---|---|---|---|
| 359,712 | 3/1887 | Catlin | 242/129.8 |
| 1,969,710 | 8/1934 | Jones | 2/438 |
| 1,994,103 | 3/1935 | Huey | 2/8 |
| 2,119,439 | 5/1938 | Parmelee | 2/8 |
| 2,259,680 | 10/1941 | Caudell | 2/8 |
| 2,485,117 | 10/1949 | Settle | 2/8 |
| 2,592,805 | 4/1952 | Hutchinson | 2/8 |
| 2,687,523 | 8/1954 | Bernhardt | 2/8 |
| 2,886,819 | 5/1959 | Uphoff | 2/438 |

FOREIGN PATENT DOCUMENTS

| | | | |
|---|---|---|---|
| 2511243 | 9/1976 | Fed. Rep. of Germany | 2/438 |

*Primary Examiner*—Peter P. Nerbun

*Attorney, Agent, or Firm*—Robert C. Baker

[57] ABSTRACT

The face and head protective hood assembly has a window plate for vision, a movable flexible transparent film over the window plate, payout means for the film, and take-up means for removing soiled film. The payout means consists essentially of an elongated housing with a narrow slot in it faced toward the hood assembly. A free-standing non-rotatable shaft is fixed centrally in the housing. A hollow payout roll of flexible transparent film is mounted for rotation about the non-rotatable shaft. Resilient means on the exterior of the non-rotatable shaft presses against the hollow interior of the payout roll to frictionally resist rotational movement of it. The take-up means consists essentially of a take-up shaft free of an external housing, a hand operated knurled wheel fixed on it, bracket means on the exterior of the hood assembly for removably mounting the ends of the take-up shaft for rotational movement by turning the knurled wheel, and a leaf spring in biased relationship against the knurled wheel to limit rotational movement of the take-up shaft to one direction only.

6 Claims, 6 Drawing Figures

HEADWEAR MOUNTED TRANSPARENT FILM DISTRIBUTING MEANS

This invention relates to improvements in a face and head protective hood assembly, and particularly to means for maintaining and rapidly replacing a flexible transparent film as a vision protector over a window plate of the hood assembly.

Many hood assemblies have heretofore been available, but the means heretofore employed for replacing protective film over the vision areas for such hoods have suffered from several defects. Complexity has been the fault of most of them; and the excessive cost of the complex structures as well as their unreliability of operation under intense vision contamination conditions have, insofar as known, prevented significant commercial adoption of them. Many bind or become inoperable under intense vision contamination conditions such as encountered in spray application of sticky plastic resin particles. Even when paints or other sticky particulate of small size constitute the environment of spraying where the hood is being used, the build-up over the vision area can rapidly obscure vision and require either replacement of discrete window shields or a stretch of transparent flexible film so as to again permit the wearer to view his work. But replacement of discrete shields is time consuming and causes loss of effective man-hours of working. Heretofore known arrangements for payout and removal of transparent film for a vision area have employed elements (such as frame elements for guiding edges of the film) which on contamination with airborne sticky particles become obstacles to the movement of contaminated film from the vision area. The sticky particulate rapidly builds up on such elements; and they must be cleaned to return the apparatus to operability. Other proposed arrangements have required movement of contaminated film through a holding assembly at the removal end; and such arrangements quickly become stuck or bound by highly contaminated film, preventing operability until cleaned.

A major advantage of the teaching of this invention is that the structural arrangements for payout and take-up of protective vision film may become highly contaminated and remain operable. No frame elements or guides for edges of the film across a vision area are employed. Exceeding simplicity is built into the structural arrangements, making them not only economical for adoption but also reliable in operation, without binding, under sever contamination conditions.

In the face and head protective hood assembly of this invention, there is a basic or permanent window plate for vision. A movable flexible transparent film serves as a replaceable protector over the outer surface of the window plate. A payout means for the film is provided, plus a take-up means for removing soiled film contaminated with vision obstruction material from the area of the window plate. The payout means and take-up means are mounted on opposite sides of the window plate, and are characterized by several special features or improvements.

The payout means consists essentially of an elongated housing attached on the exterior of the hood assembly along one edge of the window plate. The housing has a straight longitudinally extending narrow slot in it. The slot is faced toward and spaced from but proximate to the outer surface of the hood assembly. Within the housing is a free-standing non-rotatable shaft fixed to one end of the housing and substantially centrally oriented in it. A replaceable hollow payout roll of the flexible transparent film is mounted for rotation about the non-rotatable shaft within the housing. The film extends or is drawn out of the housing slot over the window plate. A resilient means is fixed along the exterior of the non-rotatable shaft and presses against the hollow interior of the payout roll to frictionally resist rotational movement of the payout roll about the non-rotatable shaft.

The take-up means consists essentially of a take-up shaft free of an external housing. A hand operated knurled wheel is fixed on the take-up shaft proximate to one end of it. Bracket means on the exterior of the hood assembly serves as the means for removably mounting the ends of the take-up shaft to permit rotational movement of it by turning the knurled wheel. The knurled wheel is at a location between the mounted ends of the take-up shaft. A leaf spring is fixed on the hood assembly in biased relationship against the knurled wheel to prevent backwind of the wheel and take-up shaft. The leaf spring allows rotational movement of the wheel and take-up shaft in one direction only. The take-up means functions in cooperation with the resilient means of the payout means as the sole structural elements for maintaining the transparent film in taut condition over the outer surface of the window plate. Further, the take-up means is operable without binding even when vision obstruction material on the transparent film is several times the thickness of the transparent film.

Additional benefits and advantages will be described by reference to a drawing, made a part hereof, wherein.

Figure 1:
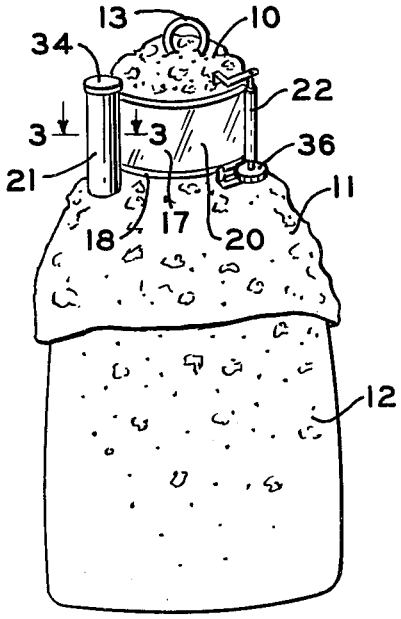
FIG. 1 is a schematic perspective view of a hood assembly of this invention.
Figure 2:
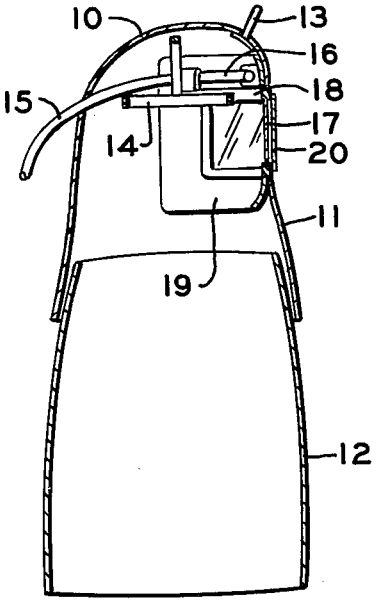
FIG. 2 is a schematic cross-section of the hood, taken on a vertical line approximately bisecting FIG. 1.
Figure 3:
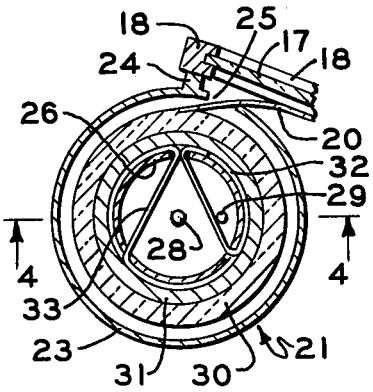
FIG. 3 is a schematic cross section of the payout means taken approximately on line 3—3 of FIG. 1.
Figure 4:
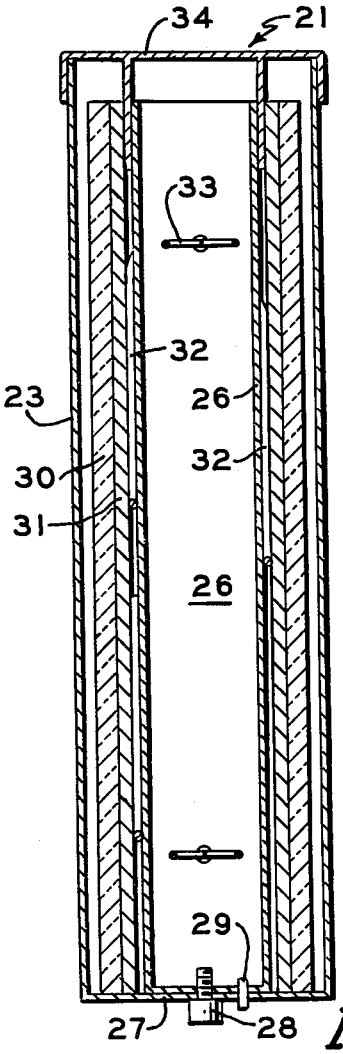
FIG. 4 is a schematic cross section of the payout means taken on line 4—4 of FIG. 3.
Figure 5:
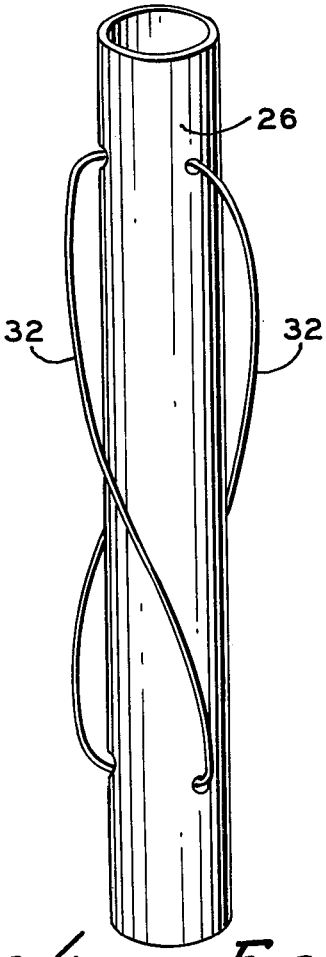
FIG. 5 is a schematic perspective view of the non-rotatable shaft which is located inside the housing of the payout means.

Referring to the drawing, the protective hood 10 may have and preferably has a depending shroud 11 for protecting a user's shoulder and chest areas. Underneath the shroud, the user may wear a smock 12. The hood assembly suitably is equipped with a hanger element, such as a ring 13, for hanging it in storage during periods of non-use.

Inside the hood any suitable system of head contacting elements may be used to space the material of the hood from continuous skin contact with the wearer. A system of straps 14 for fitting about and over the head of the wearer is useful to this end. Further, comfort of the wearer is enhanced by forcing fresh air into the hood through a conduit 15 and diffusing the air inside the hood, as by a tubular diffuser 16 at about the location of the forehead of a wearer.

At the front of the hood is a relatively large transparent plate 17 for allowing vision by the wearer. Generally, the window plate is formed of glass or a relatively thick sheet of plastic such as a polycarbonate. The window plate per se is normally a permanent part of the structure of the hood assembly. A frame 18, suitably of metal or other durable material, may extend about the window plate and hold the window plate in position. The material forming the hood, apart from the window plate area, is normally a canvas or similar flexible material. Thus, it is preferable to employ a stiffening material, or a stiff plastic sheath 19, inside the hood about the window plate area so as to enhance the structural integrity for the mounting of the window plate.

Over the window plate is a flexible transparent film 20. A payout assembly or means 21 for the film 20 is located on one side of the window plate. On the opposite side of the window plate 17 is a take-up means 22 for the film. The take-up means is operable to remove soiled or contaminated film from the area of the window plate and cause a fresh stretch of the film to extend over the outer surface of the window plate. The film protects the window plate from contamination with vision obstruction material. The film itself becomes contaminated in use, but a fresh stretch is moved into position over the window plate to permit the wearer to observe his work efforts.

Referring particularly to FIGS. 1, 3, 4, and 5, the details of structure for the payout assembly for the film will be explained. The payout assembly or means 21 has an elongated housing 23, preferably cylindrical. The housing 23 is attached or mounted on the exterior of the hood assembly. Usually, this attachment is permanent; and suitably, the housing is attached to the hood assembly along the frame 18 at one edge thereof. A space block 24 or bracket is useful to this end. The elongated length of the housing is aligned along or tangential to the frame 18 along one edge of the window plate. Illustratively, the edge may be the right edge of the window plate as viewed from the standpoint of the wearer.

The housing 23 is equipped with a straight longitudinally extending narrow slot 25. Slot 25 extends the length of the housing and is so located upon mounting of the housing to the hood that the slot is placed in a position such that it faces the hood assembly. In effect, the slot is placed in a relatively recessed location where it is shielded from severe contamination from spray material by the housing 23. The slot 25, however, is slightly spaced from the hood assembly, including the frame and window portions thereof. It is nevertheless very close or proximate to the outer surface of the hood assembly. Just sufficient space exists for transparent film material within the housing 23 to be drawn out of the slot 25 and over the window plate 17.

Inside the housing 23 is a free-standing non-rotatable shaft 26. One end of shaft 26 is fixed to one end 27 of the housing, as by a screw fastener 28. The shaft 26 extends within the housing 25 at about a central location, e.g., approximately an axial location within the preferred cylindrical housing illustrated. A pin 29, suitably fixed in the housing end wall 27 and extending through an eccentrically located hole or recess in the base of shaft 26, serves to prevent rotation of shaft 26 with respect to the housing 23. Thus, shaft 26 is easily removed from the housing 23 should need arise for doing so.

About fixed shaft 26 is mounted a replaceable hollow payout roll 30 of flexible transparent film. The payout roll of film is wound upon itself and furnishes a substantial reservoir of film for movement over the window plate before replacement of the roll is necessary. The payout roll 30 may be equipped with a core or spool 31 as a part of its total structure. Rotation of the payout roll 30 about the non-rotatable shaft 26 is possible, but special resistance elements on the exterior of the shaft 26 prevent free rotation of the payout roll and brake it against rotary movement. The payout roll is at all times protected against contamination by the housing 23. The end wrapping of film on the payout roll extends through the slot 25 over the window plate.

Along the exterior of the non-rotatable shaft 26 is a structure which is best characterized as a resilient means 32. It may vary in its details, but it functions to press against the hollow interior of the payout roll 30 so as to frictionally resist rotational movement of the payout roll about shaft 26, but nevertheless permit such rotational movement for the payout roll when the stress of pulling film out of slot 25 exceeds the frictional resistance to rotary motion afforded by the resilient means 32. The most effective resilient means 32 is an assembly of spaced wire elements (metal or plastic) loosely spiraled about shaft 26 and extending substantially perpendicularly outwardly therefrom at their very end positions of mounting on the shaft 26. The wires 32 suitably extend into shaft 26 and through it as a bracing network 33. A single length of wire can be convoluted in and out of holes in shaft 26 to form the resilient means on the exterior of the shaft. The assembly of wire functions somewhat as a plurality of leaf springs in pressing against the interior of the payout roll 30 to resist rotary motion of it. However, wires are preferred over leaf springs inasmuch as cutting or chafing damage to the interior of payout rolls, or the core 31 thereof, as well as any resultant binding of the payout roll against rotational movement, are obviated by their use, as illustrated. Nevertheless, a variety of resilient means other than a metal wire assembly can give useful results. Spongy resilient means, rubber bands, metal pressure plates, and the like offer possible alternatives, but ones not as attractive and wear resistant nor as easily maintained and reliable as the wire assembly.

A cap or cover 34 over the upper end of the housing 23 serves with the housing to completely enclose the payout roll but for the slot exit opening 25 of the housing. As so enclosed, fresh uncontaminated payout film is maintained for drawing over the window plate under even the most severe environmental use conditions, as where sticky particles (such as plastic resin particles, for example) are encountered.

Useful transparent flexible films for payout may vary. Mylar (polyethylene terephthalate) is especially satisfactory. Cellophane may be used satisfactorily in several applications. Other synthetic flexible transparent films may offer special benefits for selected applications.

The take-up assembly 22 is exceedingly simple, but effective even when contamination on the protective transparent film over the window plate becomes excessive and reaches several times the thickness of the film. It consists essentially of a take-up shaft 35 which is free of any external housing about it. Near or proximate to one end of the take-up shaft is a knurled knob or wheel 36. The wheel 36 is fixed immovably to the shaft 35 and is accessible for hand rotation by an operator. Brackets 37 and 38 are mounted on the exterior of the hood assembly, that is, on the frame 18 of the hood assembly, and serve as the means for mounting the axis ends of the take-up shaft to permit rotation of it. The simplicity of the construction of the take-up means is especially to be stressed. The knurled wheel 36 and shaft 35 are between the mounting brackets 37 and 38 for the same. The mounting brackets are biased toward each other and are sufficiently resilient to be pressed apart to allow easy and quick removal of the assembly consisting of the wheel 36 and shaft 35. Rotation of the take-up shaft is simply accomplished by hand turning of the knurled wheel 36. A leaf spring 39 is fixed on the hood assembly, that is, on bracket 38, and presses in biased relationship against the knurled wheel 36. This action of the leaf spring allows rotational movement of the wheel 36 and the take-up shaft 35 as a unit. The rotational movement is limited to one direction, and is effective for winding the film 20 on shaft 35. Backwind of the wheel, and of wound soiled film, is prevented by the leaf spring 39.

Figure 6:
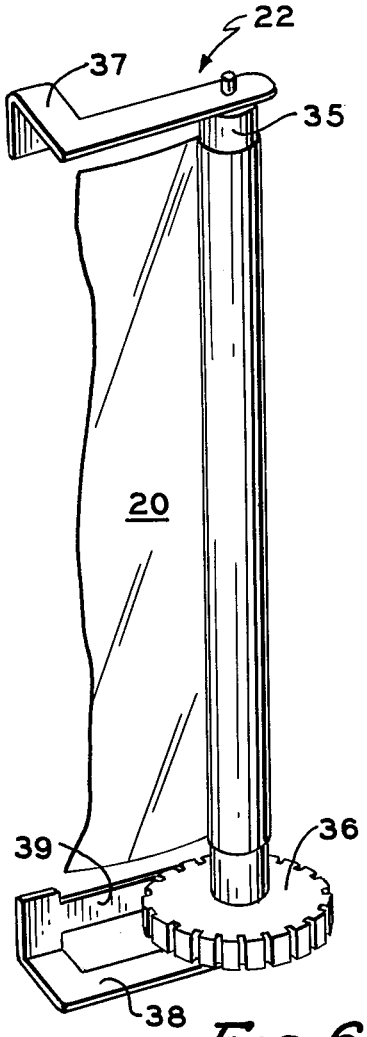
FIG. 6 is a schematic perspective view of the take-up assembly of the invention.

Thus, as the knurled wheel is rotated in a clockwise direction (as it is viewed in FIG. 6), wind up of contaminated film 20 occurs about shaft 35. Simultaneously, the pull of the film 20 by the take-up shaft 35 causes the film to be pulled out of the payout means and fresh film to be placed over the window plate. The take-up means, and particularly its leaf spring arrangement, functions in cooperation with the resilient means or wires 32 of the payout assembly as the sole structural elements for causing the film to be taut over the outer surface of the window plate. Most important is the fact that arrangement is workable despite extreme build up of contamination on the film 20. The take-up means remains operable without binding even when the vision obstruction material contaminates the transparent film to the extent of a build up reaching several times the thickness of the transparent film. Even contamination of the take-up means does not seriously hamper operability.

In a relative sense, the slot 25 of the payout means and the take-up shaft 35 should be about parallel with each other, and on opposite sides of the window plate 17, preferably at the lateral sides of the window plate. Further, the projection or contour of the window plate should be such that it bulges outward or forward of a common plane in which the slot 25 and take-up shaft 35 both lie. This preferred arrangement inherently causes the protective film 20 to lie in snug contact over the window plate between the payout and take-up means.

While a slit or adhesive means may be employed as the starting holder for film 20 on the take-up shaft, a more simple construction is that formed by employing a take-up shaft having a surface structure of friction grip material, suitably of rubbery character. An initial wrap of film 20 about such a shaft furnishes sufficient friction surface contact for the take-up assembly to function as above described.

The invention thus provides a reliably efficient and yet exceedingly simple assembly for workers to wear for their own protection as well as one allowing rapid replacement of soiled film over the window plate as fresh film is needed to permit vision. In tests, the assembly has been found to save approximately one to one and one-half man hours per day as compared to the practice, heretofore prevalent, requiring replacement of discrete disposable window shields over the window plate.

That which is claimed is:

1. In a face and head protective hood assembly having a window plate for vision, a movable flexible transparent film as a replaceable protector over the outer surface of said window plate, payout means for said film, and take-up means for removing soiled film contaminated with vision obstruction material from the area of said window plate, said payout means and said take-up means being mounted on opposite sides of said window plate, the improvements wherein, (i) said payout means consists essentially of an elongated housing attached on the exterior of said hood assembly along one edge of said window plate, a straight longitudinally extending narrow slot in said housing, said slot being faced toward and spaced from but proximate to the outer surface of said hood assembly, a free-standing non-rotatable shaft fixed to one end of said housing and substantially centrally oriented within said housing, a replaceable hollow payout roll of said flexible transparent film mounted for rotation about said non-rotatable shaft within said housing, said film being drawn out of said slot over said window plate, and resilient means fixed along the exterior of said non-rotatable shaft for pressing against the hollow interior of said payout roll to frictionally resist rotational movement of said payout roll about said non-rotatable shaft, and (ii) said take-up means consists essentially of a take-up shaft free of an external housing, a hand operated knurled wheel fixed on said take-up shaft proximate to one end thereof, bracket means on the interior of said hood assembly for removably mounting the ends of said take-up shaft to permit rotational movement thereof by turning said knurled wheel, said knurled wheel being at a location between said mounted ends of said take-up shaft, and a leaf spring fixed on said hood assembly in biased relationship against said knurled wheel to prevent backwind of said wheel and said take-up shaft but allow rotational movement thereof in one direction only, whereby said take-up means functions in cooperation with said resilient means of said payout means as the sole structural elements for maintaining said transparent film in taut condition over the outer surface of said window plate, said take-up means being operable without binding even when vision obstruction material on said transparent film is several times the thickness of said transparent film.

2. The hood assembly of claim 1 wherein said elongated housing is substantially cylindrical at said non-rotatable shaft is substantially axially oriented therewithin.

3. The hood assembly of claim 1 wherein said slot of said payout means and said take-up shaft are substantially parallel and lie in a plane behind at least a portion of said window plate.

4. The hood assembly of claim 1 wherein said resilient means on said shaft of said payout means comprises an assembly of wires.

5. The hood assembly of claim 1 wherein said take-up shaft comprises a surface structure of friction grip material.

6. The hood assembly of claim 1 wherein said take-up shaft comprises a surface structure of rubbery friction grip material.

* * * * *